US008240253B2

(12) United States Patent
Theurer et al.

(10) Patent No.: US 8,240,253 B2
(45) Date of Patent: Aug. 14, 2012

(54) METHOD AND MACHINE FOR COMPRESSING BALLAST OF A RAIL TRACK

(75) Inventors: Josef Theurer, Vienna (AT); Herbert Wörgötter, Gallneukirchen (AT)

(73) Assignee: Franz Plasser Bahnbaumaschinen-Industriegesellschaft mbH, Vienna (AT)

( * ) Notice: Subject to any disclaimer, the term of this patent is extended or adjusted under 35 U.S.C. 154(b) by 119 days.

(21) Appl. No.: 12/741,738

(22) PCT Filed: Oct. 17, 2008

(86) PCT No.: PCT/EP2008/008797

§ 371 (c)(1),
(2), (4) Date: May 6, 2010

(87) PCT Pub. No.: WO2009/068139

PCT Pub. Date: Jun. 4, 2009

(65) Prior Publication Data

US 2010/0242781 A1 Sep. 30, 2010

(30) Foreign Application Priority Data

Nov. 27, 2007 (AT) ..... A 1923/2007

(51) Int. Cl.
*E01B 27/02* (2006.01)
*E01B 29/16* (2006.01)

(52) U.S. Cl. ..... 104/2; 104/7.1; 104/10

(58) Field of Classification Search ..... 104/2, 3, 104/5, 7.1, 7.2, 7.3, 10, 12
See application file for complete search history.

(56) References Cited

U.S. PATENT DOCUMENTS

| | | | | |
|---|---|---|---|---|
| 4,799,430 A * | 1/1989 | Theurer | ..... | 104/2 |
| 5,205,218 A | 4/1993 | Theurer | | |
| 5,231,929 A * | 8/1993 | Theurer et al. | ..... | 104/2 |
| 5,640,909 A | 6/1997 | Theurer | | |
| 6,021,717 A | 2/2000 | Theurer | | |

FOREIGN PATENT DOCUMENTS

| | | |
|---|---|---|
| EP | 0518845 A1 | 12/1992 |
| EP | 0726360 A1 | 8/1996 |
| EP | 0887464 A1 | 12/1998 |
| FR | 2303117 A1 | 10/1976 |
| FR | 2498653 A1 | 7/1982 |
| GB | 1545574 A | 5/1979 |
| GB | 2094379 A | 9/1982 |
| WO | 2006089587 A1 | 8/2006 |

* cited by examiner

*Primary Examiner* — S. Joseph Morano
*Assistant Examiner* — Zachary Kuhfuss
(74) *Attorney, Agent, or Firm* — Laurence A. Greenberg; Werner H. Stemer; Ralph E. Locher

(57) ABSTRACT

The compression of ballast for a rail track takes place after two-stage cleaning by a cleaning machine. For this purpose, cleaned ballast is dispensed and a first ballast layer is thereby formed. The rail track which is laid on the first ballast layer has lateral oscillations imparted to it by a front stabilization unit, and the first ballast layer is thereby compressed. The formation of a second ballast layer takes place by a second chute, which second ballast layer is subsequently compressed by a rear stabilization unit.

4 Claims, 2 Drawing Sheets

METHOD AND MACHINE FOR COMPRESSING BALLAST OF A RAIL TRACK

BACKGROUND OF THE INVENTION

Field of the Invention

The invention relates to a method for consolidation of ballast of a ballast bed of a track, in which the ballast is discharged and consolidated while the track is lifted, wherein the track is set in horizontal transverse oscillations while under a vertical load, and to a machine.

Since after ballast cleaning, for example according to U.S. Pat. No. 4,770,104, the ballast bed is formed entirely anew, said ballast bed is completely uncompacted. For this reason also, it is absolutely mandatory to follow up the track position correction, carried out with the aid of tamping tools, with a consolidation of the ballast bed. To that end, the track is loaded with a static vertical load and, parallel thereto, is set in horizontal transverse oscillations. This so-called stabilisation of the track is accomplished by well-known track stabilizers (for example, U.S. Pat. No. 5,257,579).

According to GB 2 267 305, it is known to set a track lifting unit of a cleaning machine in transverse oscillations. With this, there is the possibility of lowering any ballast accumulations, caused by irregular ballast discharge, in order to achieve a more uniform vertical position of the track.

BRIEF SUMMARY OF THE INVENTION

It is the object of the present invention to provide a method or a machine of the specified type with which an improved consolidation of the ballast bed can be achieved.

According to the invention, this object is achieved with a method or a machine. In the method, ballast of a ballast bed for a track is consolidated. More specifically, after formation of a first ballast layer, the track is laid upon the first ballast layer and the track is set in horizontal transverse oscillations while under a vertical load. Additional ballast is discharged and the track is lifted, for forming a second ballast layer. Then the track is tamped. The track is set in horizontal transverse oscillations while under the vertical load. A machine is provided for performing the consolidation of the ballast of the ballast bed for the track. The machine contains a track lifting unit, a track tamping unit, a first stabilizing unit for applying a vertical load in connection with transverse oscillations to the track, and a second stabilizing unit preceding the track tamping unit with regard to a working direction.

Due to the features according to the invention, it is now possible to significantly improve the penetration effect of the track stabilisation. As a consequence of introducing the ballast in layers, the ballast compression resulting from the transverse oscillations of the track can be achieved also in deeper layers of the ballast bed. Thus, the ballast bed can be compacted in an overall more homogenous way for a more durable track position.

Additional advantages of the invention become apparent from the dependent claims and the drawing description.

The invention will be described in more detail below with reference to embodiments represented in the drawing in which

DESCRIPTION OF THE INVENTION

Figure 1:
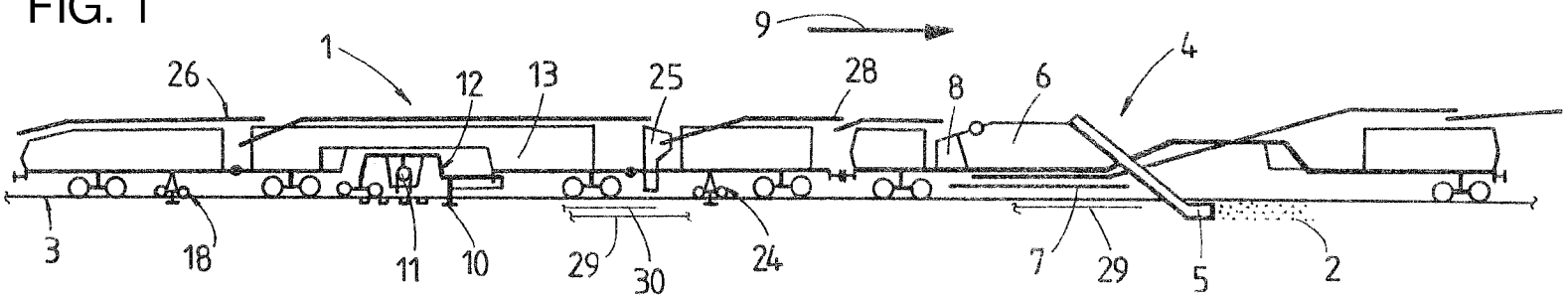
FIG. 1 shows a simplified side view of a machine for ballast consolidation and a cleaning machine, FIGS. 2 and 3 each show an enlarged side view of a front and rear section, respectively, of the machine for ballast consolidation.

Shown in FIG. 1 is a machine 1 for consolidation of ballast 2 of a track 3 as well as a cleaning machine 4. The latter is equipped with a ballast pick-up chain 5, a screening plant 6 and a discharge belt 7. A chute 8 is provided for introducing additional or new ballast.

Figure 2:
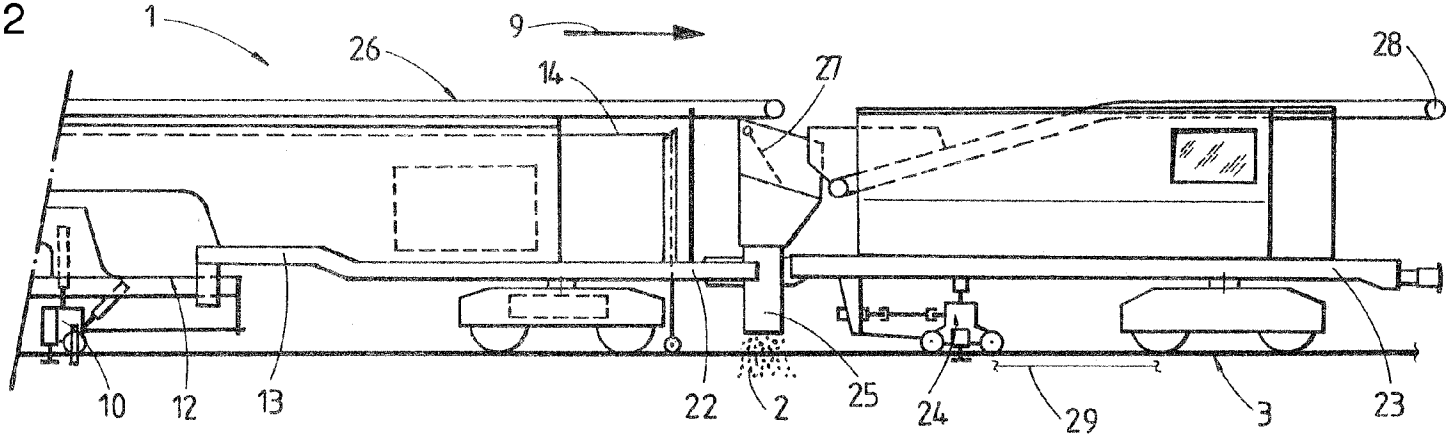
Figure 3:
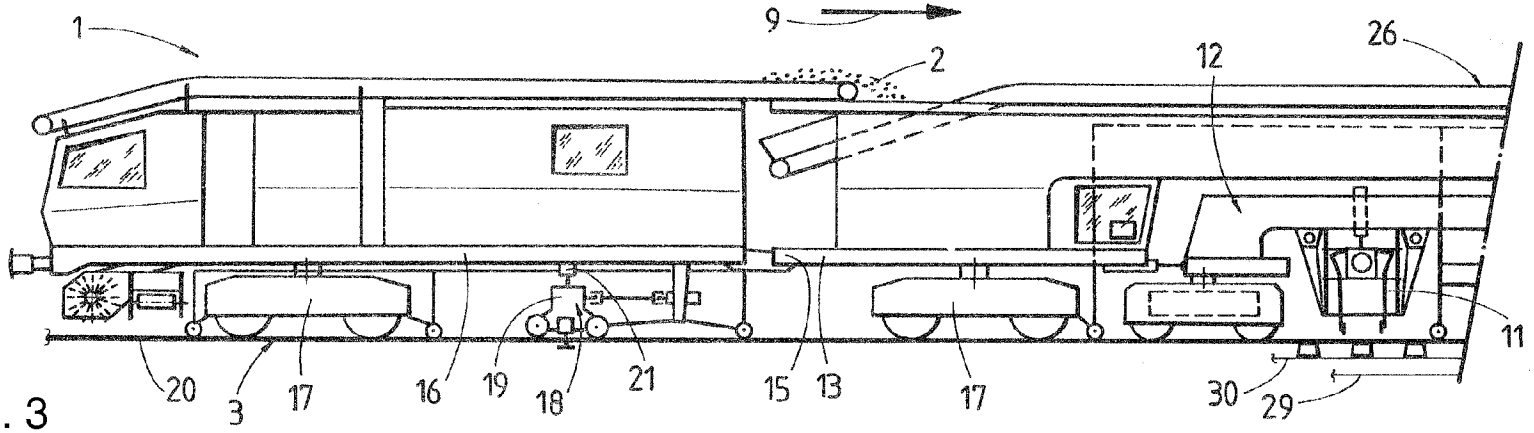

The machine 1 (see FIGS. 2, 3) for consolidation of the ballast 2 is situated—with regard to a working direction 9—immediately behind the cleaning machine 4 and is equipped with a track lifting- and tamping unit 10, 11. The two units 10, 11 are arranged on a satellite 12 which is displaceable relative to a machine frame 13. A reference system 14 is provided for correction of the track position.

Articulatedly connected to a rear end 15 of the machine frame 13 is a rear frame part 16 which has a first or rear stabilising unit 18 located between two undercarriages 17. For producing horizontal transverse oscillations, said stabilising unit 18 is connected to an eccentric drive 19 and may be brought into form-fitting engagement with rails 20 of the track 3 by means of roller clamps. Drives 21 arranged between the frame part 16 and the stabilising unit 18 serve for applying vertical static loads upon the track 3.

Articulatedly connected to a front end 22 of the machine frame 13 is a front frame part 23 which is connected to a second or front stabilising unit 24. The latter precedes the tamping unit 11—with regard to the working direction 9—and is configured just like the already described first stabilising unit 18.

Arranged between the front, second stabilising unit 24 and the track lifting unit 10 is a ballast chute 25 for discharging the ballast 2. A conveyor belt 26, extending in the longitudinal direction of the machine, for ballast transport in the working direction 9 of the machine 1 is provided above the tamping- and stabilising units 11, 18, 24. Located above the ballast chute 25 is a deflection device 27 for selectively deflecting the ballast 2 from the conveyor belt 26 into the ballast chute 25. A front discharge end 28 of the conveyor belt 26 projects beyond the front frame part 23 in such a way that new ballast 2 (see FIG. 1) can be transported onto a conveyor belt and into the chute 8 of the cleaning machine 4, as desired.

The method according to the invention will be described in more detail below: A first ballast layer 29 is formed by discharging upon the track 3 the ballast 2 which has been cleaned in the screening plant 6. The track 3, which is laid upon the first ballast layer 29 by a lifting device (not shown) of the cleaning machine 4, is set in horizontal transverse oscillations under vertical load with the aid of the front stabilising unit 24. As a result, the first ballast layer 29 is consolidated.

Parallel thereto, new ballast 2 is continuously supplied from storage wagons (not shown) to the conveyor belt 26 which spans the entire machine 1. The ballast 2 is transported in the working direction 9 of the machine 1 and, in dependence upon the deflection device 27, discharged into the ballast chute 25 and, if desired, also into the chute 8 of the cleaning machine 4.

The ballast 2 discharged via the ballast chute 25 forms a second ballast layer 30, with the track 3 being lifted by the trailing track lifting unit 10. After tamping by the tamping unit 11, the track 3 is again loaded with a vertical load with the aid of the rear stabilising unit 18 and simultaneously set in horizontal transverse oscillations. Thus, the second or upper ballast layer 30 is consolidated.

During the entire working operation, the train formation—consisting of the machine 1 for two-step ballast consolidation and the cleaning machine 4—travels continuously in the working direction 9. As a consequence of a relative displacement of the tamping- and the track lifting unit 11, 10, cyclical tamping of the track 3 is possible parallel to the continuous forward travel.

Figure 4:
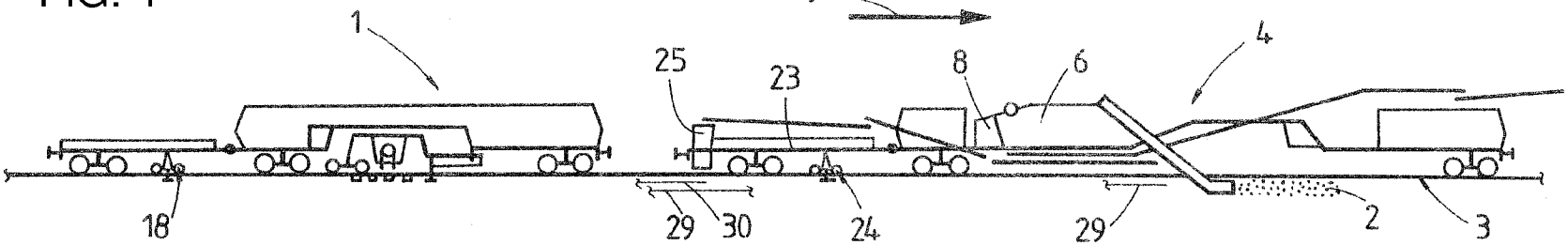
FIG. 4 shows a variant of a machine combination for cleaning and consolidation of the ballast bed.

A variant of the invention, indicated schematically in FIG. 4, differs in that the front frame part 23 is connected to the cleaning machine 4. Additionally, the ballast 2 for both the first and the second ballast layer 29, 30 is supplied from the screening plant 6.

The invention claimed is:

1. A method for consolidation of ballast of a ballast bed for a track, which comprises the steps of:

after formation of a first ballast layer, laying the track upon the first ballast layer and setting the track in horizontal transverse oscillations while under a vertical load;

discharging additional ballast and lifting the track, for forming a second ballast layer;

tamping the track; and setting the track in horizontal transverse oscillations while under the vertical load.

2. A machine for consolidation of ballast of a ballast bed for a track, the machine comprising:

a track lifting unit;

a track tamping unit;

a first stabilizing unit, following said track tamping unit with regard to a working direction, for applying a vertical load in connection with transverse oscillations to the track; and a second stabilizing unit preceding said track tamping unit with regard to a working direction.

3. The machine according to claim 2, further comprising a ballast chute, following said second stabilizing unit with regard to the working direction, for discharging the ballast and disposed between said second stabilizing unit and said track lifting unit.

4. The machine according to claim 3, further comprising:

a conveyor belt, extending in a longitudinal direction of the machine, for ballast transport in the working direction of the machine and disposed above said track tamping unit and above said first and second stabilizing units; and a deflection device for selectively deflecting the ballast from said conveyor belt into said ballast chute and disposed above said ballast chute.

* * * * *